US010549132B2

(12) United States Patent
Murray et al.

(10) Patent No.: US 10,549,132 B2
(45) Date of Patent: Feb. 4, 2020

(54) BREATHING APPARATUS COMPLIANCE SYSTEM

(71) Applicant: CSE Corporation, Export, PA (US)

(72) Inventors: Edward Murray, Jeannette, PA (US); Scott Shearer, Allison Park, PA (US)

(73) Assignee: CSE Corporation, Export, PA (US)

( * ) Notice: Subject to any disclaimer, the term of this patent is extended or adjusted under 35 U.S.C. 154(b) by 979 days.

(21) Appl. No.: 14/869,447

(22) Filed: Sep. 29, 2015

(65) Prior Publication Data

US 2016/0089552 A1 Mar. 31, 2016

Related U.S. Application Data

(60) Provisional application No. 62/056,927, filed on Sep. 29, 2014, provisional application No. 62/067,310, filed on Oct. 22, 2014.

(51) Int. Cl.
*A62B 9/00* (2006.01)
*A62B 7/08* (2006.01)

(52) U.S. Cl.
CPC ..... *A62B 9/006* (2013.01); *A62B 7/08* (2013.01)

(58) Field of Classification Search
CPC .. A62B 9/006; A62B 7/08; A62B 9/00; A62B 9/003; A62B 17/00; A62B 21/00; A62B 7/00; A62B 7/02; A62B 7/14; A62B 7/12; A62B 7/10; A62B 7/06; A62B 7/04; C01B 13/0296; C01B 13/00; C25B 1/02; A62D 9/00; A61M 2205/3331; A61M 2205/3327; A61M 2205/3368
See application file for complete search history.

(56) References Cited

U.S. PATENT DOCUMENTS 3,215,322 A * 11/1965 Boyer ..... A62B 25/00 206/1.5
3,773,044 A * 11/1973 Wallace ..... A62B 7/08 128/202.22
4,209,491 A * 6/1980 Rich, III ..... A62B 7/08 128/202.26
4,342,725 A * 8/1982 Collins ..... A62B 7/08 128/202.26
6,000,395 A * 12/1999 Brown ..... A41D 13/0051 128/201.29

(Continued)

*Primary Examiner* — Tu A Vo
(74) *Attorney, Agent, or Firm* — Alan G. Towner, Esq.; Leech Tishman Fuscaldo & Lampl

(57) ABSTRACT

A breathing apparatus including a case containing a chemical for generating oxygen and a monitoring circuit in the case is disclosed. The monitoring circuit includes multiple sensors to that sense parameters within the case relevant to an operational status of the breathing apparatus, and a controller to receive signals from the sensors and to produce an output signal indicating the operational status of the breathing apparatus. A method for monitoring a breathing apparatus is also disclosed. The method includes using multiple sensors within a case of a breathing apparatus to sense parameters relevant to an operational status of the breathing apparatus, and processing signals from the sensors to produce an output signal representative of the operational status of the breathing apparatus. The sensors may include humidity, impact, pressure and temperature sensors.

15 Claims, 7 Drawing Sheets

(56) References Cited

U.S. PATENT DOCUMENTS

| | | | | |
|---|---|---|---|---|
| 2003/0099157 | A1* | 5/2003 | Quine | G04F 1/005 368/10 |
| 2006/0174881 | A1* | 8/2006 | Jagger | A61M 16/10 128/201.25 |
| 2007/0215159 | A1* | 9/2007 | Ross | A62B 7/08 128/205.28 |
| 2008/0035145 | A1* | 2/2008 | Adams | A62B 18/08 128/204.18 |
| 2011/0017209 | A1* | 1/2011 | Monzyk | A61M 16/10 128/202.26 |
| 2013/0113620 | A1* | 5/2013 | Hogg | A62B 9/006 340/539.12 |
| 2013/0199523 | A1* | 8/2013 | Chen | G01S 19/17 128/202.13 |
| 2013/0226021 | A1* | 8/2013 | Dec | A62B 18/08 600/532 |
| 2014/0014099 | A1* | 1/2014 | Elliott | A62B 9/006 128/201.23 |
| 2014/0145737 | A1* | 5/2014 | Lacombe | G01D 3/00 324/713 |
| 2014/0248195 | A1* | 9/2014 | Vigier | A62B 7/08 422/240 |

* cited by examiner

BREATHING APPARATUS COMPLIANCE SYSTEM

CROSS-REFERENCE TO RELATED APPLICATIONS

This application claims the benefit of U.S. Provisional Patent Application Ser. No. 62/056,927 filed Sep. 29, 2014, and also claims the benefit of U.S. Provisional Patent Application Ser. No. 62/067,310 filed Oct. 22, 2014, both of which are incorporated herein by reference.

FIELD OF THE INVENTION

This invention relates to apparatus and methods for monitoring the serviceability of breathing apparatus.

BACKGROUND OF THE INVENTION

Emergency breathing devices are used in mining, tunneling, the armed forces, chemical plants, pulp/paper plants, water treatment plants, and confined space entry industries where immediate reliable access to breathable oxygen may be required. Such breathing devices used in the mining market require daily inspection to assure that the device is in working order and has not exceeded the usable service life based on the date of manufacture. Currently this includes a daily visual inspection of temperature and humidity indicators mounted in the case of the breathing device, verification of the manufacture date printed on the case, visual inspection for external damage to the case, and a quarterly inspection of the chemical bed using a hand held sound monitor.

SUMMARY OF THE INVENTION

An aspect of the present invention is to provide a breathing apparatus comprising: a case containing at least a chemical for generating oxygen; and a monitoring circuit within the case, the monitoring circuit including a plurality of sensors configured to sense parameters within the case relevant to an operational status of the breathing apparatus, and a controller configured to receive signals from the sensors and to produce an output signal indicating the operational status of the breathing apparatus.

Another aspect of the present invention is to provide a method for monitoring a breathing apparatus, the method comprising: using a plurality of sensors within a case of a breathing apparatus to sense parameters relevant to an operational status of the breathing apparatus; and processing signals from the sensors to produce an output signal representative of the operational status of the breathing apparatus.

DETAILED DESCRIPTION

The present invention provides a breathing apparatus including a compliance system capable of monitoring relevant environmental conditions that can degrade the function of the breathing apparatus. In various embodiments, the compliance system may include several hardware components. These components can include circuitry configured to monitor one or more parameters that may be relevant to the operational status of the breathing apparatus. The monitored parameters can be used to produce data that can be output, for example, through a data interface or wireless transmitter. The data can then be received at a receiving device, such as a hand held reader or a fixed reader. In some embodiments, the monitored parameters can be used to produce a visible indication of the operational status of the breathing device.

Figure 1:
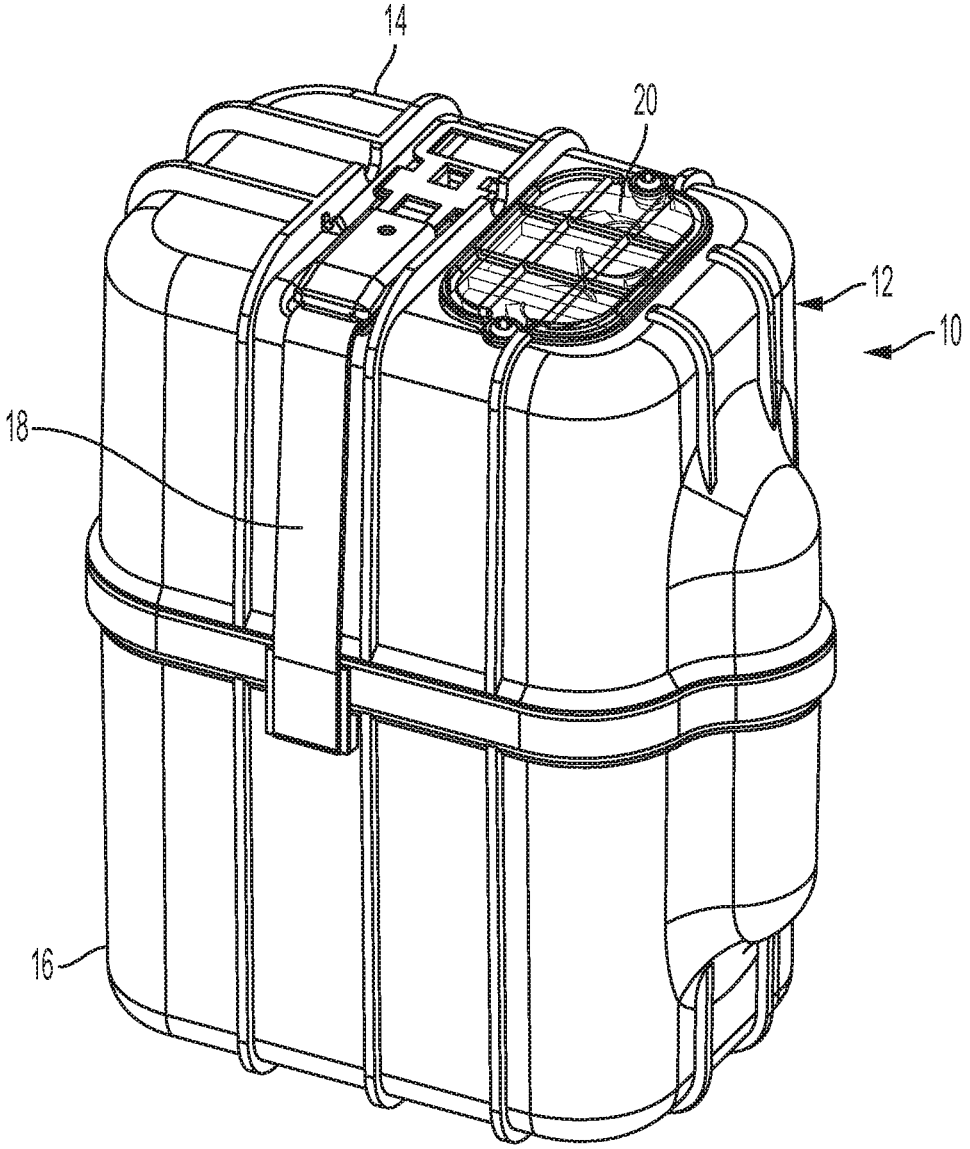
FIG. 1 is an isometric view of a breathing apparatus compliance system in accordance with an embodiment of the present invention.

FIG. 1 is a pictorial representation of a self-rescuer emergency breathing apparatus 10. The self-rescuer operates by recycling the exhaled breath and chemically removing carbon dioxide while replenishing oxygen based on the user's demand or work rate. The recycling function of the self-rescuer emergency breathing apparatus 10 may operate in a similar manner as commercially available self-rescuers, such as those sold by CSE Corporation under the designation Self-Rescuer Long Duration or SRLD. The self-rescuer 10 includes a canister 12 that contains a chemical (such as for example, $KO_2$) for generating oxygen, and typically includes other well-known components such as a mouthpiece; a canister that contains chemical(s) for absorbing carbon dioxide and generating oxygen; an oxygen cylinder; a breathing bag; and shoulder, neck and/or wrist straps, not shown in this view. The case includes a top portion 14 and a bottom portion 16. A band 18 secures the top portion to the bottom portion of the case. A window 20 is provided to allow a visual inspection of certain components in the case.

In some embodiments, the self-rescuer utilizes a bi-directional chemical canister system, where the exhaled air moves through a carbon dioxide absorption/oxygen generation canister twice, before the oxygen returns to the user. In view of the possible life-saving nature of the self-rescuer, it is necessary to verify the serviceability of the self-rescuer. For example, excessive humidity or temperature within the case could adversely affect the ability of the chemical to produce oxygen.

Figure 2:
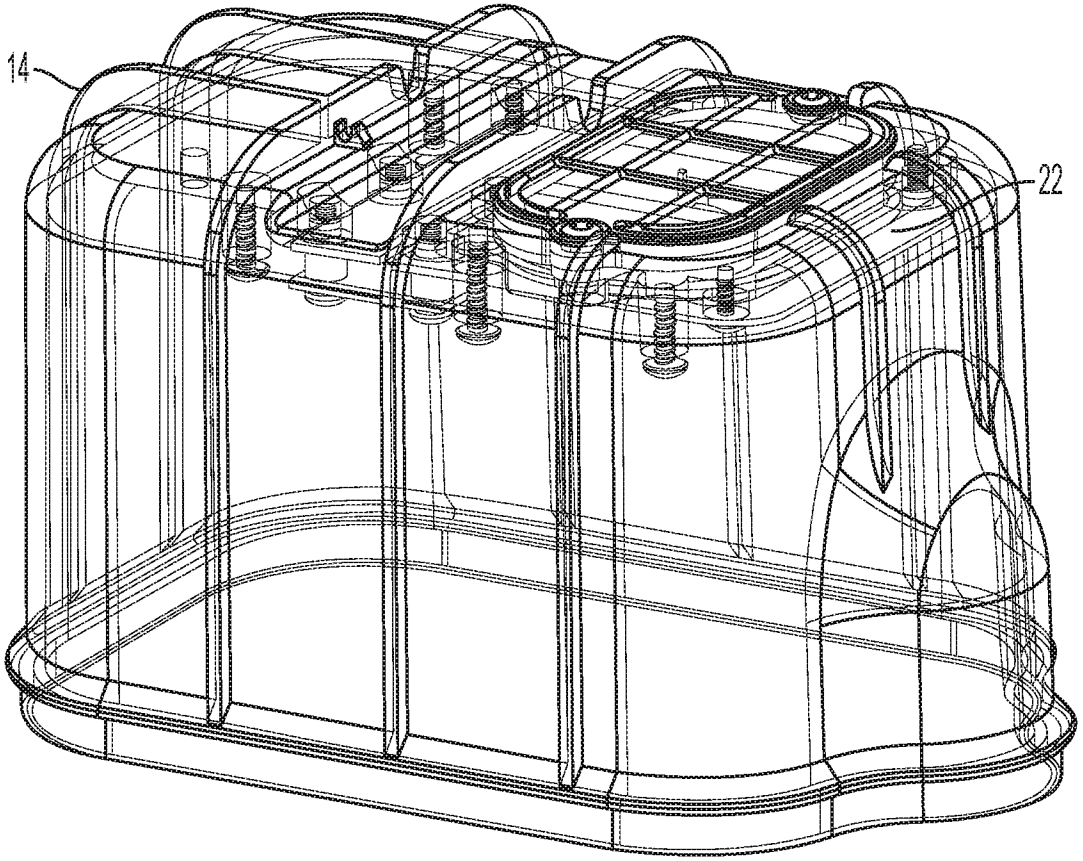
FIG. 2 is a top isometric view of a top portion of the breathing apparatus of FIG. 1.
Figure 3:
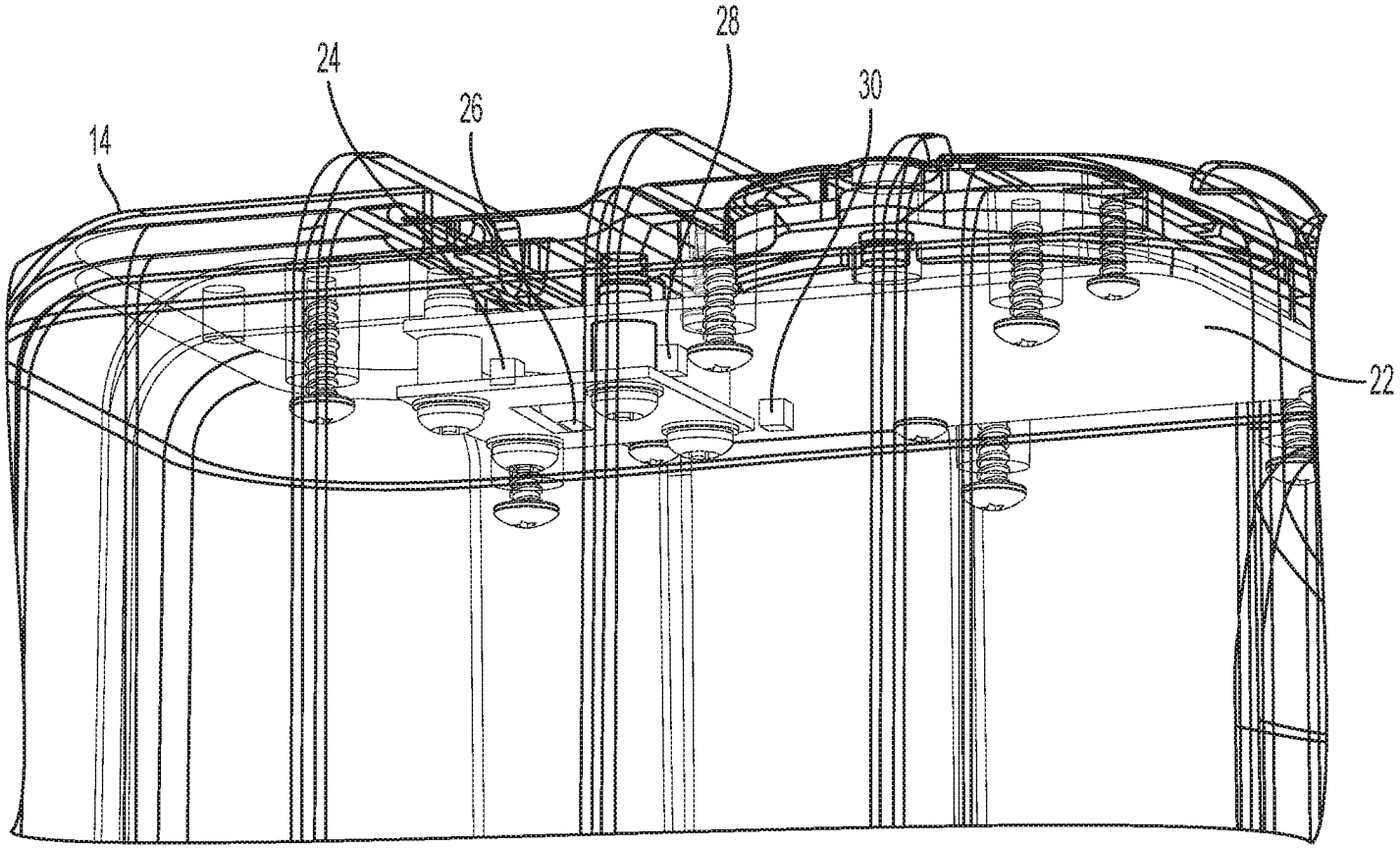
FIG. 3 is a bottom isometric view of a top portion of the breathing apparatus of FIG. 1.

FIGS. 2 and 3 are pictorial representations of a part of top portion 14 of the case 12 of the self-rescuer breathing apparatus 10 of FIG. 1. The top portion 14 is shown to include monitoring components mounted on a circuit board 22 that is positioned adjacent to the window 20. The monitoring components can include a humidity sensor 24, an impact sensor 26, a pressure sensor 28, a temperature sensor 30, and other electronic components that process signals from the sensors and produce an output representative of the operational status of the breathing apparatus. In the embodiment of FIGS. 2 and 3, the circuit board 22 is connected to the upper portion 14 of the case 12 using a plurality of mounting screws.

In the embodiment shown, the circuit board 22 is located inside and near the top of the self-rescuer emergency breathing apparatus 10. A single circuit board may thus contain all of the sensors. The status LED should be visible to the user, but could be separated from the main circuit board 22 in certain embodiments. If the self-rescuer emergency breathing apparatus 10 has more than one sealed chamber, a humidity sensor and a pressure sensor may be provided in each sealed chamber.

Figure 4:
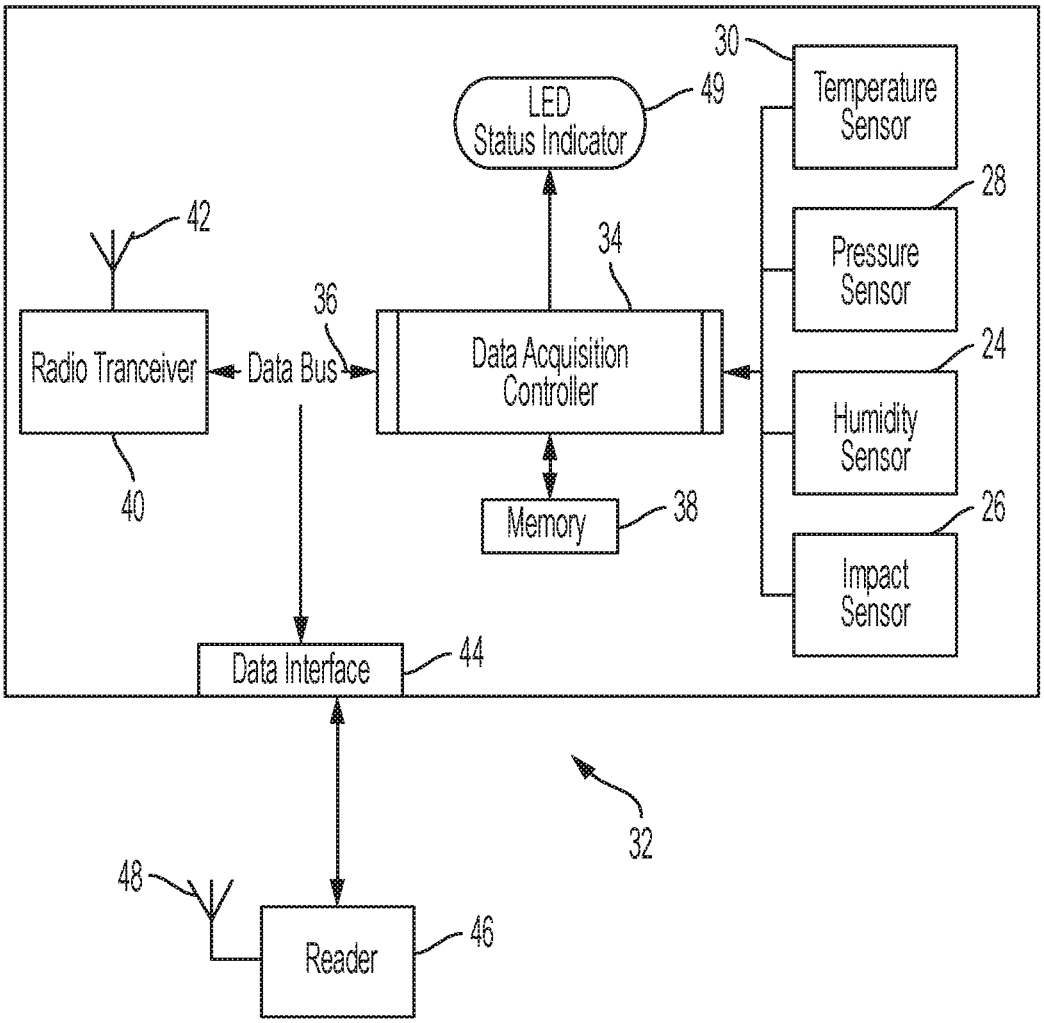
FIG. 4 is a simplified block diagram of components for monitoring the operational status of a breathing apparatus in accordance with an embodiment of the present invention.

FIG. 4 is a simplified block diagram of components that can be used for monitoring environmental parameters that are relevant to the serviceability of a breathing apparatus. The monitoring circuitry can be configured to monitor several environmental parameters. Components of the monitoring circuit can be mounted on a circuit board installed in the breathing apparatus. The main components of the monitoring circuit of FIG. 4 include the microcontroller, environmental sensors, status indicator and radio transceiver. The microcontroller manages data acquisition from the sensors, power consumption, radio communications, and status indicator control. The sensors monitor temperature 30, air pressure 28, humidity 24, and impact 26.

The monitoring circuitry 32 of FIG. 4 includes a controller 34 that can be a programmable microprocessor, and plurality of sensors including a humidity sensor 24, an impact sensor 26, a pressure sensor 28, and a temperature sensor 30. The controller is programmed or otherwise configured to receive signals from the sensors and to produce an output signal on line 36 that is representative of the operational status of the breathing apparatus. A memory 38 is included to store data collected from the sensors. The circuit can be powered by a battery (not shown).

The controller output signal includes information relevant to the serviceability of a breathing apparatus. In some embodiments, the output can be a binary pass/fail signal. In other embodiments, the output signal can include detailed information about the parameters measured by the sensors.

The signal at the output of the controller can be sent to a radio transceiver 40 that transmits the information contained in the output signal using antenna 42. Alternatively, or in addition, the output signal on line 36 can be sent to a data interface 44. A receiver 46 is configured to receive the data on antenna 48 and/or by a connection to the data interface.

The controller can also be configured to drive a status indicator, such as a light emitting diode 49. The status indicator can then alert the user in the event that one or more of the monitored parameters exceed predetermined levels during use or storage. The status indicator can be visible through the window of the case.

An external reader may be configured to receive data from the monitor monitoring circuit, for example from the data interface, or over the air using an antenna. The reader can be a mobile and/or stationary unit, and can be battery operated or hardwired. The reader may be configured to query the monitoring circuitry for the status of the breathing apparatus, for example using a cable connected to the data interface or via the near field radio transceiver. This data collected by the reader can include the unique identification of the breathing apparatus, the breathing apparatus status, recorded sensor data and operating life of the unit. The unique identification may comprise a serial number assigned during manufacture and programmed into the monitoring circuit. The data can be retrieved from the reader using a plug-in external memory or the reader can be connected to a computer for data transfer. When the reader is stationary or fixed, it can be mounted in any desired location, such as a doorway, wall, or adjacent to a storage unit for the monitors. In one embodiment, battery life of the monitoring circuit may be increased by placing a fixed reader in or near a storage unit for the monitors, in which case the reader may "ping" the nearby monitoring circuits in order to activate their radio transceivers, rather than having the monitoring circuits periodically send transmissions.

The data interface can be a stand alone component that allows the hand held or fixed reader to communicate with network protocols that are not native to the compliance system. These can include but are not limited to Ethernet, Wireless networks and cell networks.

Data collected from the monitor can be stored or printed for compliance verification. Collection may include transfer over a wireless network connection or wired link. The data can also be maintained in a central database and monitored for the customer as a service. Status alerts can be sent via email, text message or other messaging methods to one or more recipients. Messages can include information such as current breathing apparatus status, remaining service life or retrieved sensor readings.

An on-board, real-time clock may also be provided in the monitoring circuit. In one example, the clock can be initiated when the unit is made, and set to expire after a predetermined amount of time, e.g., an "end-of-service-life" signal may then be generated, displayed and transmitted as described above. The clock function can be performed within the microcontroller, or by a separate component.

Examples of suitable humidity sensors 24 for use in the present breathing apparatus include conventional capacitive, resistive, or thermal conductivity type sensors. The humidity sensor may trip at any desired humidity level, e.g., at least 70%, 80% or 90% relative humidity.

Examples of suitable pressure sensors 28 for use in the present breathing apparatus include conventional piezoelectric, capacitive, inductive, resistive, or strain gauge sensors. Pressure switches may also be used to detect pressure changes within the case. The pressure sensor 28 determines if the high pressure oxygen cylinder inside the sealed case 12 develops a leak, which would cause the internal pressure in the case 12 to rise.

Examples of suitable temperature sensors 30 for use in the present breathing apparatus include conventional thermocouples, resistive temperature devices such as thermistors, infrared radiators, bimetallic devices, liquid expansion devices, molecular change-of-state, silicon diodes and the like. A threshold temperature may be mandated by, e.g., NIOSH requirements. A primary purpose of the temperature sensor is to assure that the internal plastic, rubber, and urethane components are not damaged by excessive temperature exposure. It is noted that once a unit is sealed during manufacture it may not be opened until use, and there may be no way to inspect the internal components for temperature damage.

Figure 5:
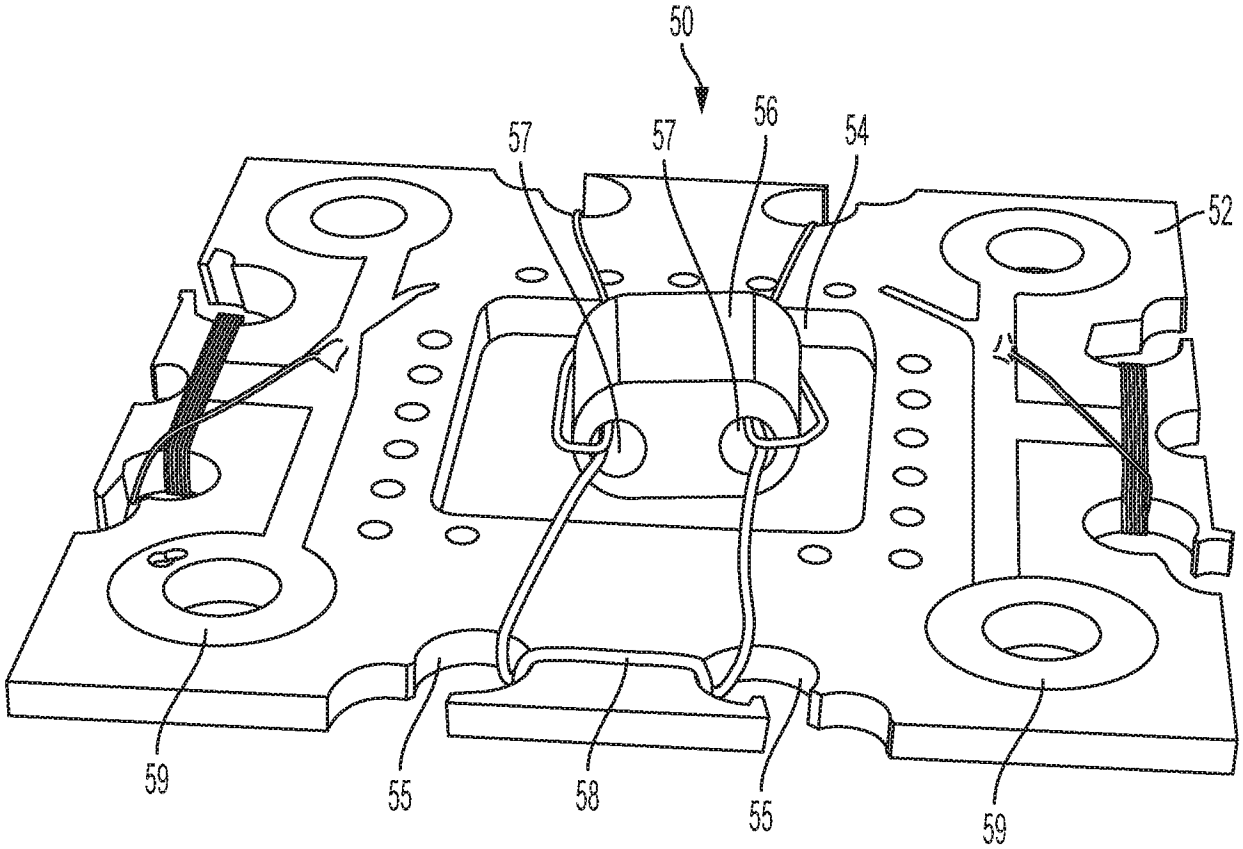
FIGS. 5-7 are isometric, top and bottom views, respectively, of an impact sensor for use in a breathing apparatus compliance system in accordance with an embodiment of the present invention.
Figure 6:
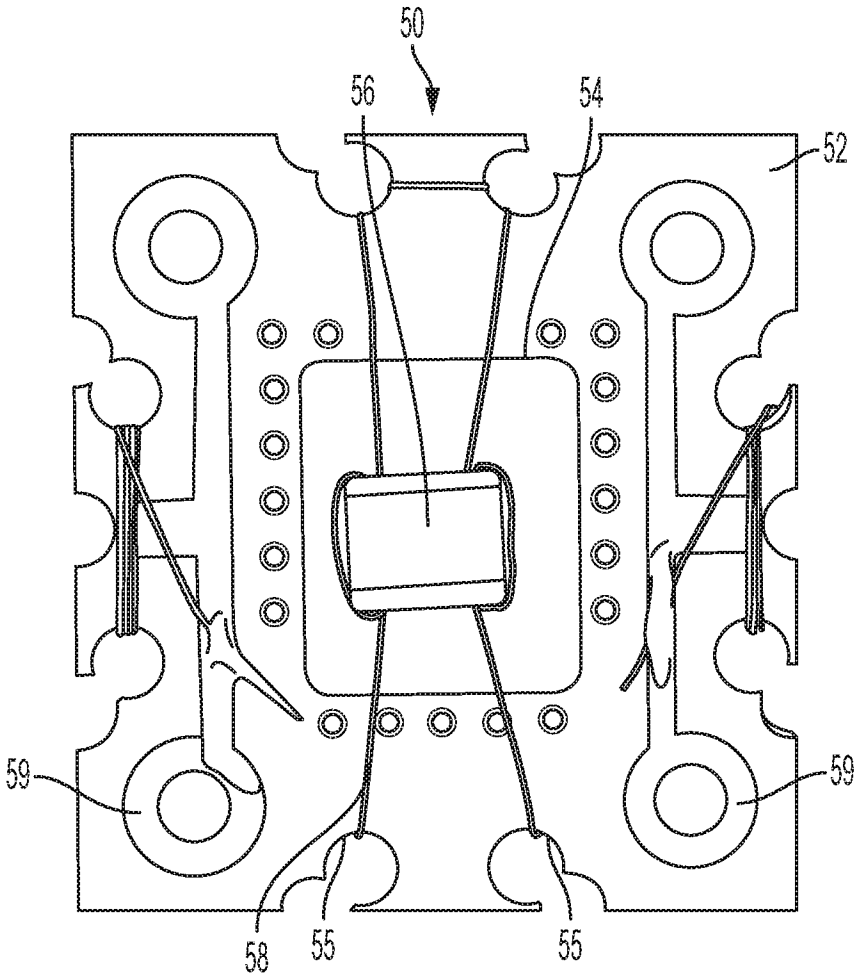
Figure 7:
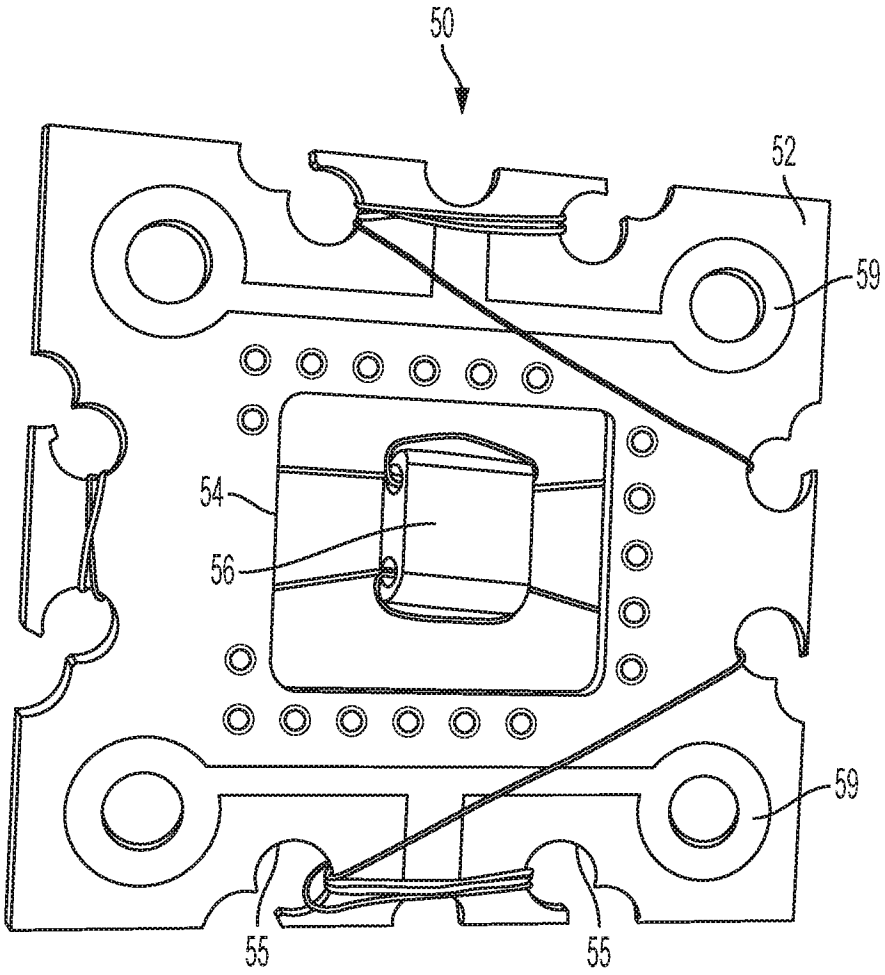

The impact sensor 26 may be of any suitable conventional design. In certain embodiments, the impact sensor 26 may comprise an impact sensor design 50 as shown in FIGS. 5-7. The impact sensor 50 includes a support board 52 with a central cut-out 54 and peripheral holes or notches 55. Although the impact sensor 50 is shown as a stand-alone unit in FIGS. 5-7, it is to be understood that the support board 52 may comprise part of the circuit board 22 shown in FIGS. 2 and 3. A bead 56 is located in the cut-out 54 of the support board 52, and is supported by a wire 58. In the embodiment shown, the wire 58 passes through two holes 57 extending through the bead 56. The bead 56 may be made of any suitable material having a selected mass, such as ceramic. In addition to supporting the bead 56, the wire 58 is wound through the notches 55 of the support board 52 as shown in FIGS. 5-7. Conductive pads 59 are provided on the support board 52 in contact with the wire 58. The wire 58 may be soldered to pads 59. When the impact sensor 50 is subjected to a threshold level of a single shock and/or repetitive shocks, the weight of the bead 56 may serve to break the wire 58, thereby interrupting the circuit formed by the wire 58 and conductive pads 59.

Wrapping of the wire 58 in the cut-outs 55 of the support board 52 as shown in FIGS. 5-7 maintains the desired amount of tension on the wire 58. The wire 58 may be routed around the support board 52 where it is bent around sharp edges of the notches 55. The notch 55 edges can be plated to give consistency on the edges, and may provide a way to adjust sensitivity. However, plating may not be needed in other embodiments. By wrapping the wire 58 through and around the bead 56, the bead 56 can be kept in substantially the same position as the wire 58 stretches due to impact forces applied to the sensor. The type and size of the wire 58 can be selected such that the wire stretches as the sensor incurs shock. The mechanical properties of the wire 58, such as its gauge, affect the impact sensor's sensitivity. Uninsulated copper wires, or wires of materials other than copper, can be used to vary the shock sensor's response to the shock incurred. The mounting notch 55 dimensions can be changed to meet the requirements of the sensor.

In certain embodiments, cumulative impact forces will cause the bead 56 to move, e.g., vibrate, and stretch the wire 58 from which the bead is suspended until the wire 58 eventually breaks, causing an open circuit. The sensor 50 may work in all directions, but one axis may be more sensitive than others. Multiple sensors may be used to respond to impacts from different directions, but a single sensor is adequate for many applications.

The impact sensor wire 58 can be connected to an electrical ground. In one embodiment, the microprocessor includes an internal pull-up resistor that can be selected as general purpose input to which the impact sensor 50 is connected. When the impact sensor 50 is in its normal state, a general purpose input pin may be shorted to ground by the sensor. When the impact sensor 50 is subjected to one or more impacts, the wire 58 can stretch and eventually break. If the wire 58 breaks and the impact sensor 50 becomes an open circuit, then the voltage on the general purpose input may switch to a high level, e.g., goes to a logic level voltage of about 5 volts. This change in voltage can then be detected by the microprocessor and used to produce a signal indicating that the sensor 50, and thus the device having the sensor, has been subjected to excessive impact forces. Once the circuit is open, there is no way to reset the device.

The impact sensor 50 may be used to detect single impact events. However, the sensor can also are used to detect cumulative impacts, e.g., an article including the sensor is dropped 20 times from a height of 5 feet. In certain embodiments, the impact sensor 50 may be constructed or tuned in order to sense various types of impact forces such as vibrational amplitudes and/or frequencies of cumulative impacts. The components of the impact sensor 50 may be adjusted in order to change the force(s) required to break the wire(s) and open the circuit. For example, the mass of the bead 56 may be adjusted and/or the tension or cross-sectional area of the wire 58 may be changed.

The status of each breathing apparatus can be stored along with a unique identifier for reporting and regulatory compliance using a wireless reader. The status may be a pass/fail indication, historical data, or both. This information may be stored in a memory in the breathing apparatus and/or at some other location.

The disclosed embodiment can monitor the temperature, humidity, impact exposure, oxygen cylinder integrity, and service life of a breathing apparatus. However, other types or numbers of parameters may be monitored in accordance with other embodiments of the invention.

While the present invention has been described in terms of several embodiments, it will be apparent to those skilled in the art that various changes can be made to the disclosed embodiments without departing from the scope of the invention, as set forth in the following claims.

What is claimed is:

1. A breathing apparatus comprising:

a case containing at least a chemical for generating oxygen; and a monitoring circuit within the case, the monitoring circuit including a plurality of sensors configured to sense parameters within the case relevant to serviceability of the breathing apparatus during storage of the breathing apparatus when the oxygen is not being generated by the chemical, and a controller configured to receive signals from the sensors and to produce an output signal indicating the serviceability of the breathing apparatus during the storage of the breathing apparatus prior to the generation of the oxygen by the chemical.

2. The breathing apparatus of claim 1, wherein the monitoring circuit is configured to determine if the breathing apparatus has exceeded its usable service life based on a time measurement.

3. The breathing apparatus of claim 2, further comprising:

a radio transceiver configured to receive data from the controller and to transmit a signal representative of the data.

4. The breathing apparatus of claim 2, further comprising:

a data interface configured to receive data from the controller.

5. The breathing apparatus of claim 1, wherein the sensors comprise:

a humidity sensor;

a temperature sensor;

a pressure sensor; and an impact sensor.

6. The breathing apparatus of claim 5, wherein the impact sensor is electrically connected between a pull-up resistor of the controller and an electrical ground.

7. The breathing apparatus of claim 1, wherein the sensors comprise a humidity sensor.

8. The breathing apparatus of claim 1, wherein the sensors comprise an impact sensor.

9. A method for monitoring a breathing apparatus, the method comprising:

using a plurality of sensors within a case of a breathing apparatus to sense parameters relevant to serviceability of the breathing apparatus during storage of the breathing apparatus when oxygen is not being generated by a chemical contained in the breathing apparatus; and processing signals from the sensors to produce an output signal representative of the serviceability of the breathing apparatus during the storage of the breathing apparatus prior to the generation of the oxygen by the chemical.

10. The method of claim 9, wherein the processing step is performed by a controller configured to receive signals from the sensors and to produce an output signal representative of the parameters sensed by the sensors.

11. The method of claim 10, further comprising:

transmitting the output signal to a receiver located external to the case.

12. The method of claim 11, wherein the transmitting step is performed by a radio transmitter configured to receive data from the controller.

13. The method of claim 10, wherein a data interface is configured to receive data from the controller.

14. The method of claim 9, wherein the sensors comprise a humidity sensor.

15. The method of claim 9, wherein the sensors comprise an impact sensor.

* * * * *